US006565278B2

(12) United States Patent
Paine et al.

(10) Patent No.: US 6,565,278 B2
(45) Date of Patent: May 20, 2003

(54) LEAF RETAINING MEANS

(75) Inventors: Leslie Paine, London (GB); Hugh Webb, London (GB)

(73) Assignee: Folders Galore Limited, London (GB)

( * ) Notice: Subject to any disclaimer, the term of this patent is extended or adjusted under 35 U.S.C. 154(b) by 0 days.

(21) Appl. No.: 09/773,668

(22) Filed: Feb. 2, 2001

(65) Prior Publication Data

US 2001/0055513 A1 Dec. 27, 2001

Related U.S. Application Data

(63) Continuation-in-part of application No. PCT/GB99/02476, filed on Jul. 29, 1999.

(30) Foreign Application Priority Data

Aug. 6, 1998 (GB) ..... 9817162

(51) Int. Cl.[7] ..... B42F 3/00

(52) U.S. Cl. ..... 402/70; 24/67 R; 24/67.11; 281/27.1; 402/8; 402/63; 402/75; D19/32

(58) Field of Search ..... 24/67 R, 67.11; 281/27.1; 402/28, 8, 70, 73, 75, 63, 31, 80 R, 500; D19/26, 27, 32

(56) References Cited

U.S. PATENT DOCUMENTS 605,492 A * 6/1898 Lavender ..... 402/28
944,653 A * 12/1909 Bayless ..... 402/28
1,094,019 A * 4/1914 Blattel et al. ..... 402/28
3,262,454 A * 7/1966 Shillinger ..... 281/19.1
5,213,429 A * 5/1993 Johnson ..... 402/13
5,333,962 A * 8/1994 Johnson ..... 402/13
5,405,209 A * 4/1995 Johns et al. ..... 402/26
6,196,748 B1 * 3/2001 Schwartz ..... 281/29

* cited by examiner

*Primary Examiner*—A. L. Wellington
*Assistant Examiner*—Monica Carter
(74) *Attorney, Agent, or Firm*—Clark & Brody

(57) ABSTRACT

Leaf retaining means for loosely retaining a multiplicity of leaves of material, such as sheets of paper. The leaf retaining means comprise a base portion, which is provided with at least one formation to enable it to be secured to a folder cover, and loop means, the latter has at least two points on its surface which two points are closest to an imaginary plane which does not pass through that position and which is perpendicular to the loop means, and which two points are spaced apart. The loop means are such as to enable a leaf of material, such as a sheet of paper, with a generally T-shaped aperture in it that is open at an edge of the leaf, to be releasably held by the loop means by pushing the aperture onto the loop means.

14 Claims, 8 Drawing Sheets

LEAF RETAINING MEANS

CROSS REFERENCE TO RELATED APPLICATIONS

This application is a continuation-in-part of International Application No. PCT/GB9902476, filed Jul. 29, 1999.

FIELD OF THE INVENTION

The present invention relates to leaf retaining means, for use for example in a loose-leaf folder.

BACKGROUND

One well-known construction for this kind of product comprises a plurality of openable rings secured to the spine or rear flap of a folder. The rings may be snapped open and leaves of paper having appropriate holes punched therein can be attached to the rings which can then be snapped shut to retain those leaves in the folder.

A problem encountered with such a construction is the cost of manufacture of the openable and closable rings. The mechanisms concerned occupy a relatively large volume and the folders cannot be packed flat. The mechanisms are made of a different material from the folders thus creating a recycling problem. Furthermore, the ring mechanism requires riveting, either through itself or through a holding plate.

In another previously proposed construction, a multiplicity of discs are provided, each with a flange all the way round its periphery. Leaves which are to be bound together and which may comprise a multiplicity of sheets of paper with hard sheets acting as covers and between which the sheets of paper are sandwiched, have a multiplicity of T-shaped apertures cut through the leaves along the intended spine of the folder. Each T-shaped aperture has the upright of the 'T' perpendicular to the intended spine and opens at that edge of each sheet. This enables one such disc to be inserted into each such aperture so that its flange engages the part of the aperture in each sheet corresponding to the horizontal part of the 'T'. Each of the discs engages all the sheets in this way, so that the discs are spaced apart along the spine.

The problem with this construction is that the leaves are still free to slide relative to one another such that the binding becomes strained and even fails.

SUMMARY OF THE INVENTION

The present invention seeks to provide a remedy.

Accordingly, a first aspect of the present invention is directed to leaf retaining means for loosely retaining a multiplicity of leaves of material, such as sheets of paper, the leaf retaining means comprising a base portion, which is provided with at least one formation to enable it to be secured directly or indirectly to a folder cover, and loop means, in which the loop means, in section at a given position around the loop means, has at least two points on its surface which two points are closest to an imaginary plane which does not pass through that position and which is perpendicular to the loop means and the base portion and which two points are spaced apart, the loop means being such as to enable a leaf of material, such as a sheet of paper, with a generally T-shaped aperture in it that is open at an edge of the leaf, to be releasably held by the loop means by pushing the aperture onto the loop means.

Whilst the loop means could conceivably comprise two adjacent parallel loops of wire, it is preferable that the loop means comprises a flange around a tongue of the leaf retaining means that extends from the base portion thereof.

The said imaginary plane may be the median bisector of the loop. The said two points may be spaced apart laterally of the general plane in which the loop lies.

Preferably, the flange extends on both sides of the tongue.

Preferably, the said formations comprise at least one groove adapted to be engaged by a corresponding internal edge of a folder.

In one advantageous form of the invention, the loop means are narrower at a top of the loop means to facilitate the addition or removal of leaves to the folder.

The first aspect of the present invention extends to a combination of at least two such retaining means and a folder being provided with at least two apertures at or adjacent to a spine of the folder at the respective ends thereof, the shape of each hole in the folder corresponding to that of the base portion of each such retaining means, the latter having been slid into the apertures in the folders.

This aspect of the present invention also extends to a folder having such retaining means and leaves of material, such as sheets of paper, formed with generally T-shaped apertures at the two ends of one side thereof for engaging the said retaining means, the T-shaped apertures opening at one of the edges of the leaf.

Each leaf may comprise a folded sheet with the T-shaped apertures being formed at the fold. As a result, if there are only two retaining means at a top and bottom of this sheet, the latter may be opened whilst still being retained in the retaining means and in the opened state there is substantially no obscurity of the central regions of the opened leaf.

Preferably, the folder has two parallel slots extending away from each aperture formed therein, so that the material of the folder between the slots yields to facilitate insertion of the base portion of the retaining means into the aperture of the folder and then the part of the material between the slots may be snapped against one end of the base portion of the retaining means to firmly secure the latter in the folder. At least one groove in the base portion of the retaining means can be provided to receive an edge of this folder material between the slots.

The folder may be made of a metal or metal alloy. In that case, at least some of the internal edges which define the apertures may be serrated to improve the securing of the retaining means in the folder.

According to a second aspect of the present invention, there is provided retaining means for retaining a multiplicity of leaves of material, such as sheets of paper, in a folder comprising a retainer extending upwardly from a base portion of the retaining means, the base portion being provided with a groove to engage inner edges of a folder.

According to a third aspect of the present invention, there is provided a folder cover, at least one leaf retainer extending from the inside of a cover, and at least one removable leaf of material, such as a sheet of paper, having a T-shaped aperture cut at an edge thereof so that what constitutes the upright of the 'T' is open at an edge of the leaf.

The present invention extends to a stamp device for stamping two such T-shaped apertures at the ends of an edge of a leaf of material, such as a sheet of paper.

Examples of retaining means made in accordance with the present invention will now be described with reference to the accompanying drawings, in which:

DETAILED DESCRIPTION OF THE PREFERRED EMBODIMENT

Figure 1:
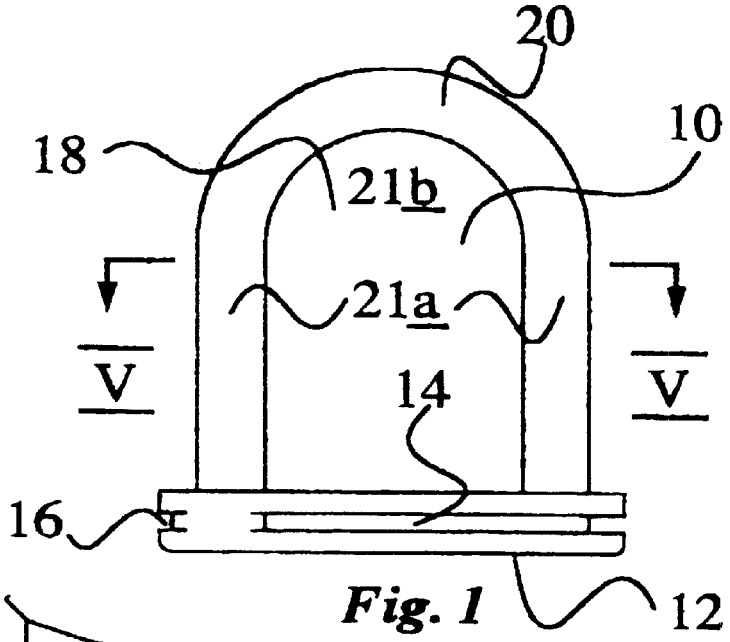
FIG. 1 shows a side view of such retaining means.

The retaining means shown in FIGS. 1 to 5 comprises a clip 10 having a base or foot 12 around a front edge of which, and along the sides thereof extends a groove 14 and in the rear of which is formed a second groove 16. A tongue 18 projects upwardly from the foot 12, and around the periphery of the tongue 18 is formed a flange 20. The flange 20 has two generally straight portions 21*a* extending from the foot 12 to respective ends of an arcuate portion 21*b* of the flange that extends around the tip of the tongue 18. The whole clip is made integrally as a single injection moulded polypropylene component.

Figure 5:
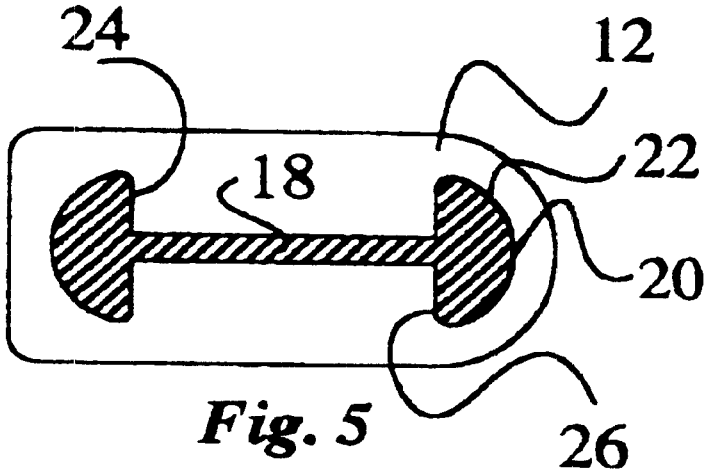
FIG. 5 shows a sectional view of retaining means shown in FIG. 1 taken along the line V—V thereof.

As can be seen more clearly from FIG. 5, the flange 20 comprises a rounded outer surface 22, and two flats 24 and 26 on opposite sides of the tongue 18.

Figure 1A:
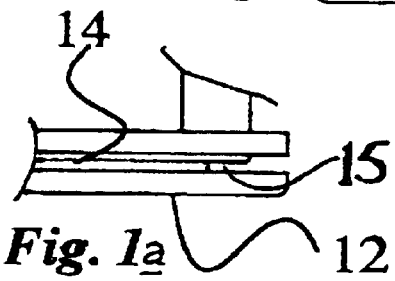
FIG. 1*a* shows part of a side view of a modified form of the retaining means shown in FIG. 1.
Figure 2:
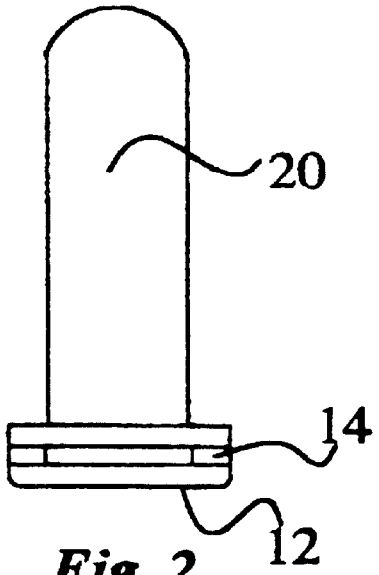
FIG. 2 shows an end view of such retaining means.
Figure 3:
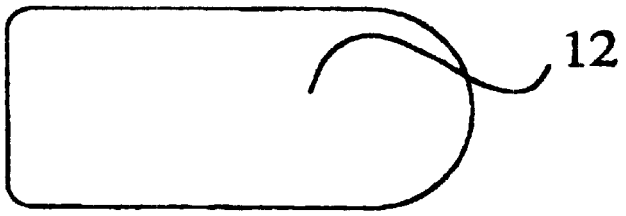
FIG. 3 shows an underneath view of such retaining means.
Figure 4:
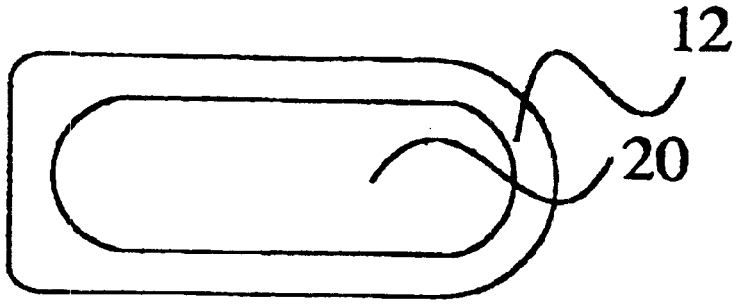
FIG. 4 shows a view from above of such retaining means.

As is evident from FIG. 1*a,* the groove 14 may be stepped, to provide a groove 15 which is deeper but narrower than the groove 14, to accommodate folders of a thickness selected from more than one thickness.

Figure 6:
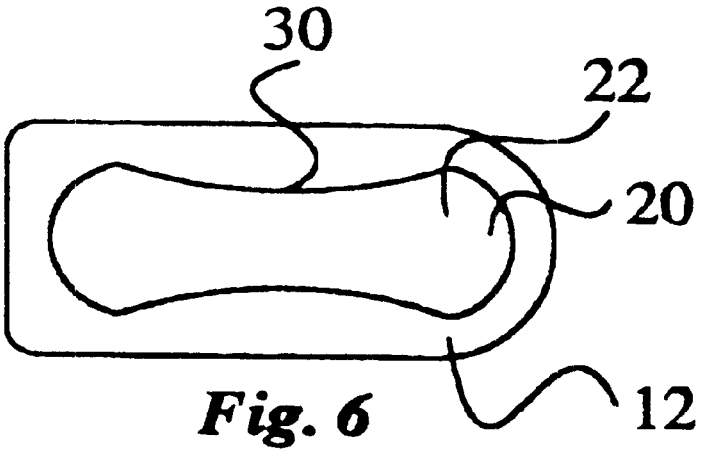
FIG. 6 shows a view from above of modified retaining means.

In the modification shown in FIG. 6, the flange 22 is scalloped or otherwise thinned in the region 30 at the tip of the tongue.

A series of pairs of clips may be provided, each pair comprising two identical clips, and the feet of all the clips, both of the same pair and of different pairs, being identical in shape and size, but the straight portions 21*a* of different pairs being of respective different lengths, to accommodate different numbers of leaves.

Figure 7:
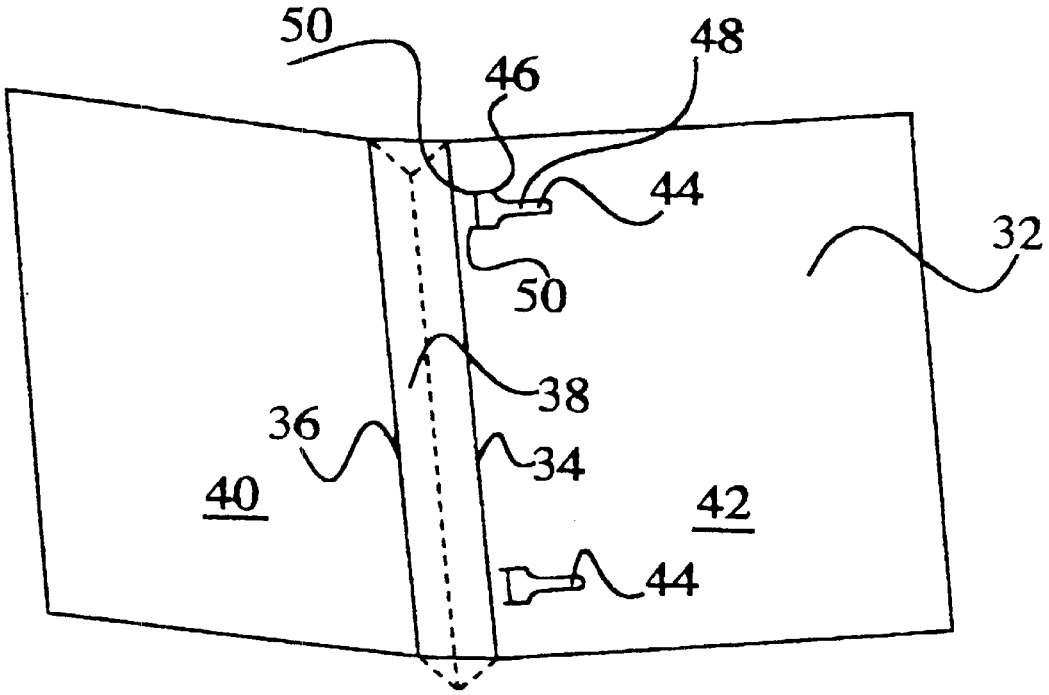
FIG. 7 shows a perspective view of a folder provided with apertures for receiving two retaining means such as the one shown in FIGS. 1 to 5.

FIG. 7 shows a folder 32 made of cardboard or polypropylene. It has two fold lines 34 and 36 between which extends the spine 38. The latter itself may be folded as shown in ghosted form to accommodate different amounts of paper. Extending from each line 34 and 36 is a front and rear flap 40 and 42 respectively of the folder 32.

In the rear flap 42 adjacent to the spine 38 and at the upper and lower ends thereof, there are provided two apertures 44. Each of these apertures 44 has an elongate rectangular portion 46 which is only slightly wider than the foot 12 of a clip 10, as shown in FIGS. 1 to 5, and a further elongate portion 48 extending from The rectangular portion 46, the portion 48 having a rounded end and generally following the contour of the inside of the groove 14 of the clip, as shown in FIGS. 1 to 5. Two slots 50 at the upper and lower ends of the rectangular portion 46 of the aperture 44 extending inwardly therefrom towards the spine 38.

Figure 8:
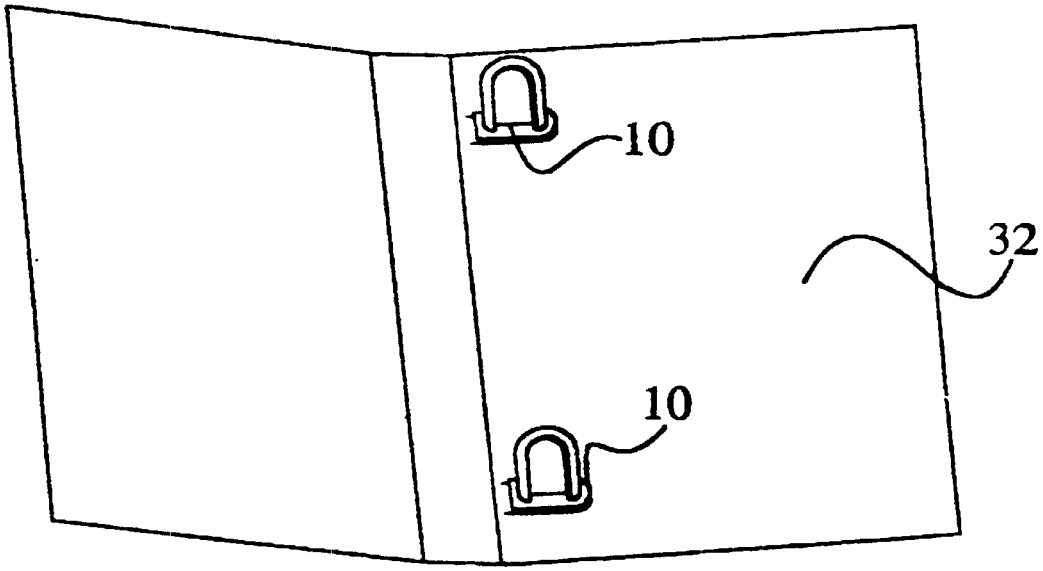
FIG. 8 shows a perspective view of a folder shown in FIG. 7 with such retaining means inserted therein.
Figure 7A:
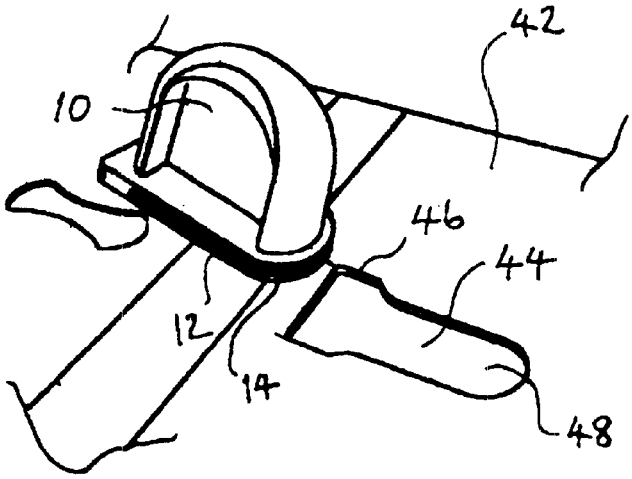
FIGS. 7*a* to 7*c* show perspective views of part of the folder and retaining means shown in FIG. 7, at successive stages during the insertion of the retaining means in the folder.
Figure 7B:
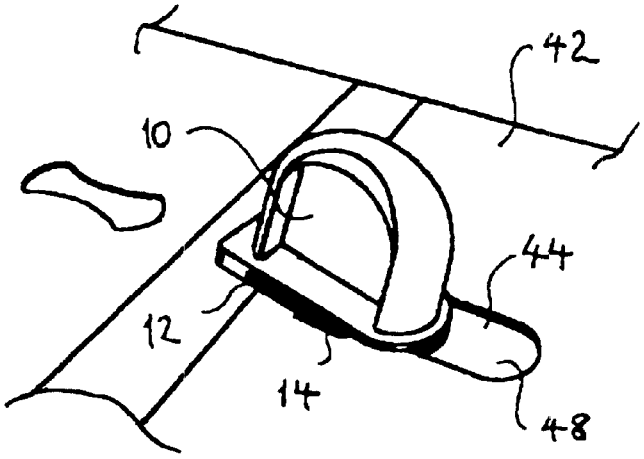
Figure 7C:
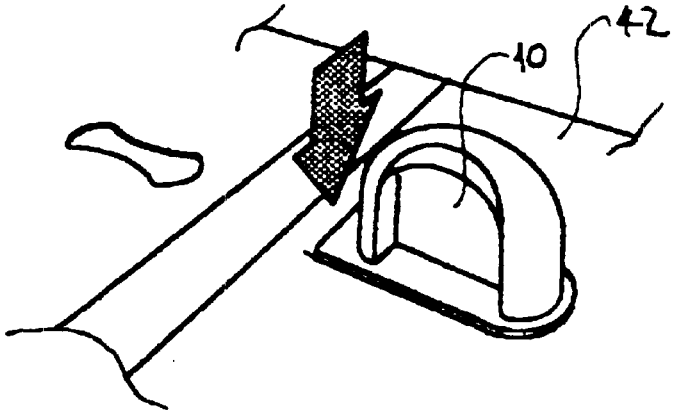

Respective clips, each as shown in FIGS. 1 to 5, are then inserted into the apertures. The front end or nose of the base 12 of each clip 10 is inserted into the rectangular portion 46, as shown in FIGS. 7*a* and 7*b,* and the portion of the folder between the slots 50 can yield a little to facilitate this. With the edges of the folder 32 which define the portion 44 of the aperture 48 engaging the groove 14, the nose of the base portion 12 is pushed towards the rounded end of the portion 48 of the aperture 44, as shown in FIG. 7*b,* until the portion of the folder between the slots 50 snaps back behind the base 12 to engage the groove 16 therein, as shown in FIG. 7*c*. This secures the clip 10 firmly in the folder 32. The same procedure is followed for each of the clips 10 shown in FIG. 8.

If the clip 10 has the form as shown in FIG. 1*a,* the thickness of the material of the folder 32 would be thinner, and the aperture 44 would be slightly smaller, than as shown in FIGS. 7 to 7*c*.

Figure 9:
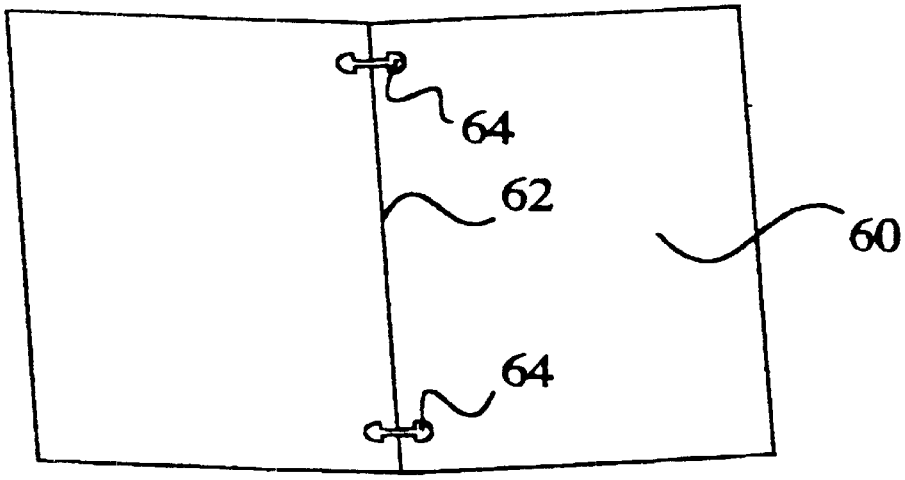
FIG. 9 shows a large leaf of material, such as a sheet of paper, folded and provided with apertures such that, in the folded state, there appear to be two generally T-shaped apertures open to the folded edge close to the ends thereof.

A double sheet of paper such as that labelled 60 in FIG. 9 has a fold 62 along the centre thereof. With the sheet 60 folded double, a generally key-hole shaped or T-shaped aperture 64 is punched therein with what constitutes the upright of the 'T' opening at the fold 62.

Figure 10:
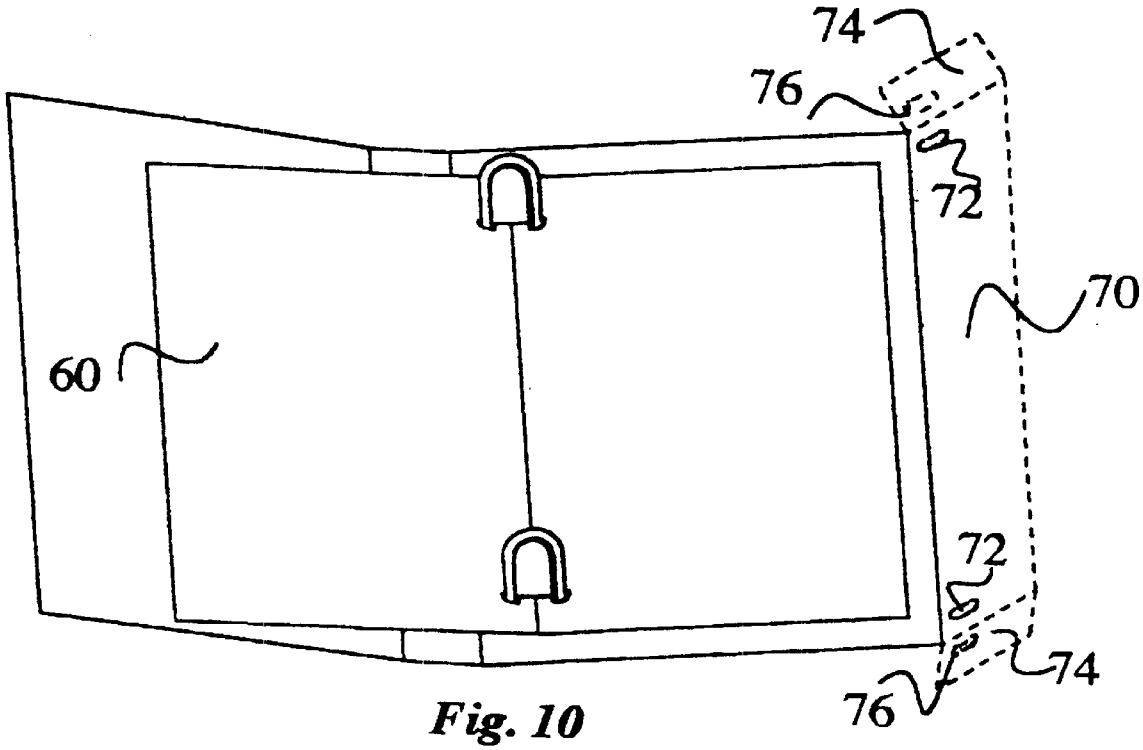
FIG. 10 shows a folder as shown in FIG. 8 with a leaf as shown in FIG. 9 held therein.

What constitutes the horizontal part of the 'T' is actually rounded on its upper edge so that when the sheet of paper 60 is unfolded, the aperture 64 straddles the fold 62 and overall appears to be a dumb-bell shape. This leaf 60 can be placed on to the folder 32 so that the clips 10 project through the apertures 64 as shown in FIG. 10. It can be seen from this Figure that there is nothing that obstructs the centre region of the leaf 60. This is particularly valuable if the latter provides a graphical image which is not to be marred by the retaining means. At the same time, the sheet 60 can be folded back double without removing it from the retaining means since one end of the aperture 64 can follow the flange 20 as one side of the leaf 60 is folded over on to the other side.

The folder may be provided with a third flap 70 with further apertures 72 for receiving further clips, each as shown in FIGS. 1 to 5. End flaps 74 may be provided at the upper and lower edges of the further flap 70, with further apertures 76 to receive the clips that are secured at the aperture 72.

Figure 11:
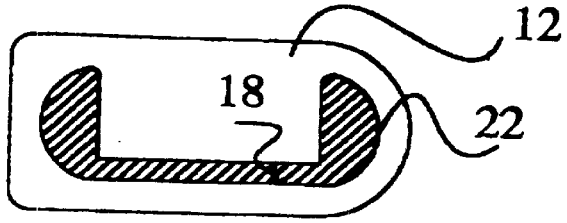
FIGS. 11, 12, and 13 show modified constructions of the retaining means shown in FIGS. 1 to 5.

In the modification of a clip shown in FIG. 11, the flange 22 extends to one side only of the tongue 18, the latter being shifted to one side of the foot 12 to facilitate this.

Figure 12:
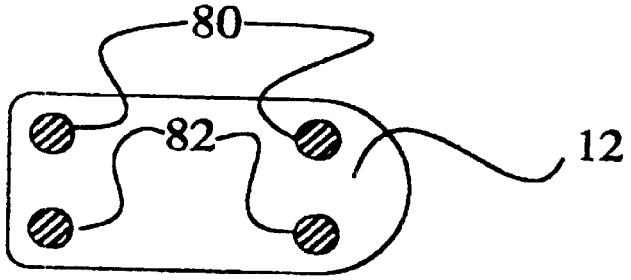

In the modification shown in FIG. 12, there is no tongue 18, and the flange 22 is replaced by two loops 80 and 82. These may be made of wire instead of plastics.

Figure 13:
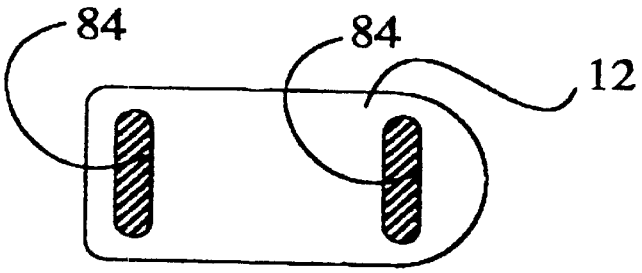

In the modification shown in FIG. 13, the loops 80 and 82 are replaced by one single loop 84 which has a width corresponding to the spacing of the loops 80 and 82.

Figure 14:
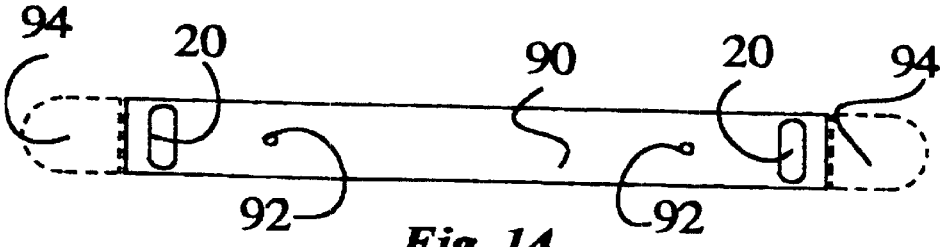
FIG. 14 shows further modification of the retaining means.

In the modification shown in FIG. 14, there is provided a diecut polypropylene strip mounting 90 with two rivet holes 92 as provided in many conventional loose-leaf ring binders, from which extends a tongue and flange portion 20, like the tongue and flange portion that extends from the base 12 of the clip shown in FIGS. 1 to 5, one such tongue and flange portion being provided at each end of the mounting 90.

The flange portions 20 may alternatively be provided as end parts 94 of the mounting 90, the latter being foldable upwardly and being held in their upwardly extending positions by a snap fit.

Alternatively, the flange portions may be parts of clips each as shown in FIGS. 1 to 5 with or without the modification as shown in FIG. 6, and each received in apertures in the strip mounting 90 each like the apertures 44 shown in FIG. 7.

Figure 15:
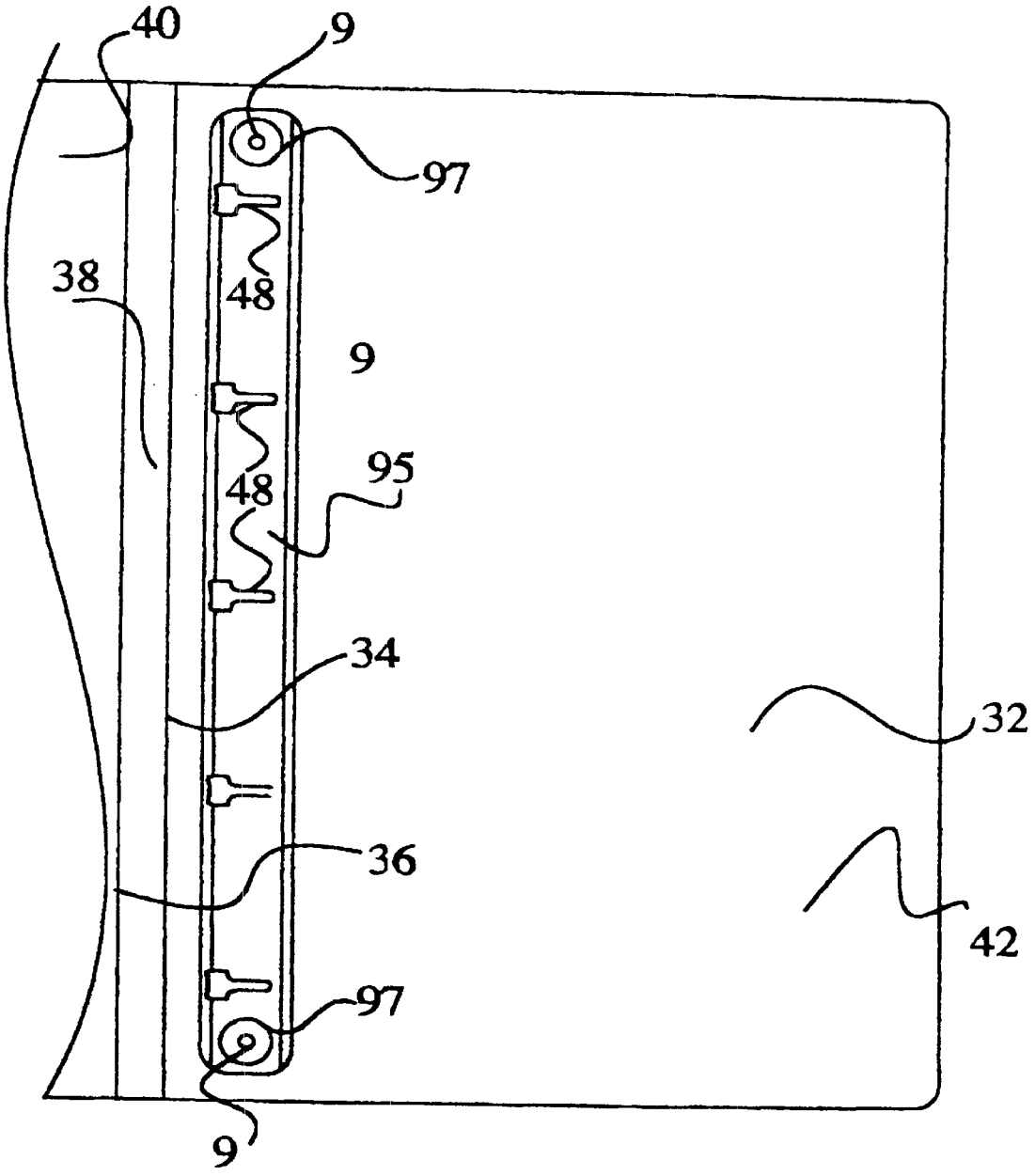
FIG. 15 shows a plan view of a further folder in open condition with a device having apertures for receiving a plurality of retaining means each as shown in FIGS. 1 to 5.
Figure 16:
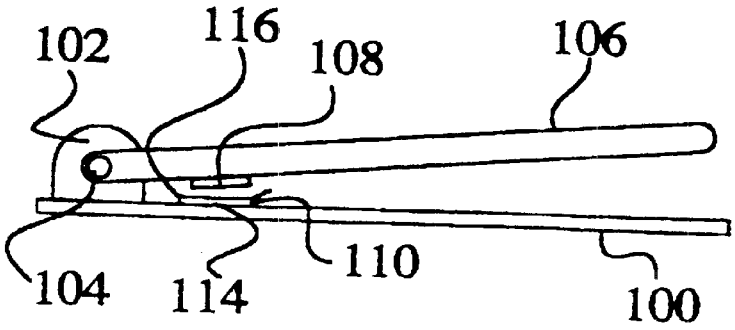
FIG. 16 shows an end view of a tool for stamping such T-shaped holes.
Figure 17:
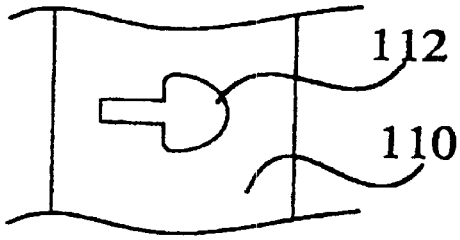
FIG. 17 shows a plan view of a section of one part of the tool shown in FIG. 16.
Figure 18:
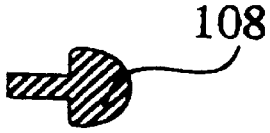
FIG. 18 shows a cross-section through a part of the tool shown in FIG. 16.
Figure 19:
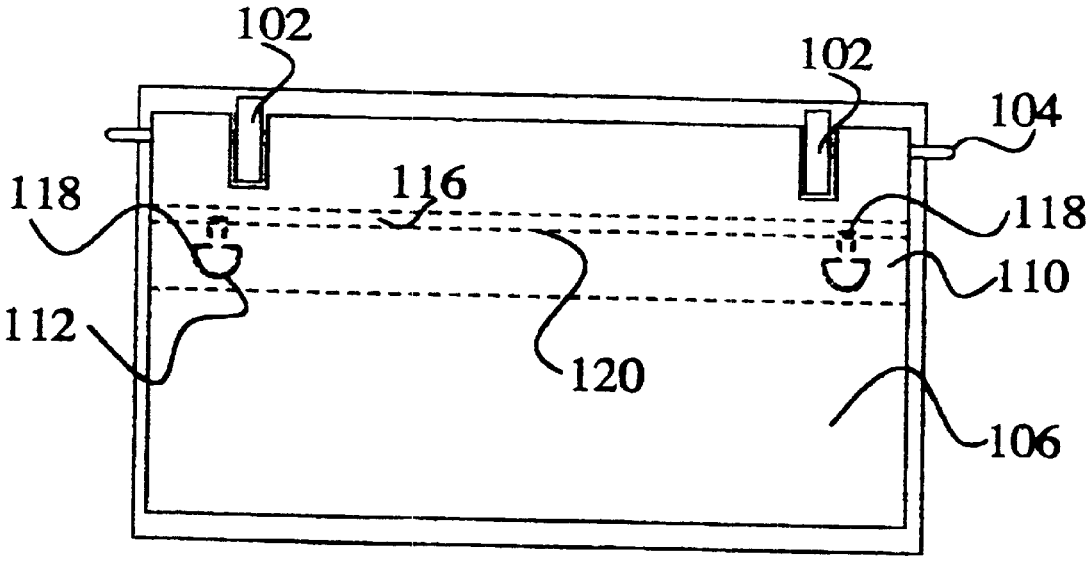
FIG. 19 shows a plan view of the tool shown in FIG. 16 with further parts thereof, not normally visible, shown in ghosted form therein.

In the modification shown in FIG. 15, each feature which corresponds to that shown in the previous Figures has been given the same reference numeral as used in those previous Figures. A hollow metal strip 95 is riveted onto the inside of the rear flap 42, adjacent and parallel to the spine 38, by two rivets 96 which extend through respective holes in the centre of respective circular troughs 97 in respective ends of a raised longitudinal central part of the strip 95, between longitudinally extending steps 98 in the metal plate of the strip 95. Five holes 48 are formed in the strip 95 uniformly spaced along its length, and each having generally the same shape, dimensions, and orientation when viewed from above as each hole 48 shown in the previous Figures.

FIGS. 16 to 19 show a tool for punching holes such as those labelled 64 in FIG. 9. It comprises a flat bed 100 upwardly from which extend two trunnions 102 through which extends a pivot axle 104. This axle 104 also extends through a lever 106.

T-shaped die-castings 108, each having a cross-section as shown in FIG. 1 extend downwardly from the lever 106, with what constitutes the upright of the 'T' in each case extending towards the axle 104. A strip 110 is mounted on the bed 100, underneath the die-castings 108. The strip 110 is provided with apertures 112 each of which generally conforms to the cross-section of each die-casting 108 and each being located so as to receive such a die-casting.

In addition, the bed 100 is provided with recesses 114 of the same shape and corresponding in location to the apertures 112 in the strip 110.

The strip 110 is mounted on the bed 100 by way of an elongate support 116 which is provided along its side further from the axle 104 with respective recesses 118 which are in registration with the what constitutes the bottom end of the upright of the 'T'.

The edge of the support 116 which is further from the axle 104 acts as an abutment surface 120 for any sheets of paper which are inserted into the tool.

With such a sheet thus inserted, the lever 106 is depressed so that the T-shaped holes are cut into the edge of the paper by the die-castings 108.

The illustrated clip may be made of any suitable metal, metal alloy, rubber, or synthetic plastics material or other castable material. The illustrated folder may also be made of any suitable metal, metal alloy, rubber, synthetic plastics material, or rigid or semi-rigid material, not necessarily the same material as the clip.

The assembly of the illustrated folder and clips does not need rivets nor any special or skilled tasks to be performed.

The tongue 18 and flange 20 of the clip 10 shown in FIG. 1 may be replaced by a ring made integrally with the base 12. The ring may be a complete closed "O" shape, or a closed "D" shape with a straight portion perpendicular to the base 12 at the end thereof further from the groove 16.

Instead of or in addition to the double sheet of paper 60, there may be one or more single sheets, or a stitched document such as a previously bound brochure. In each case, T-shaped apertures like those labelled 64 in the accompanying drawings may be formed in each sheet or document, or in tabs secured to each sheet or document.

We claim:

1. Leaf retaining element for retaining a multiplicity of leaves of material in a folder comprising a retainer having two spaced, generally straight portions attached to a base portion, the retainer extending upwardly from the base portion wherein the base portion extends between and joins said generally straight portions and is provided with a groove to engage inner edges of the folder, the groove extending around an intended front of the base portion and along the sides thereof.

2. Leaf retaining element according to claim 1, wherein the retainer comprises a loop, has at least two points on its surface that are closest to an imaginary plane which does not pass through that position and which is perpendicular to the loop and the base portion and which two points are spaced apart, the loop being such as to enable a leaf of material, such as a sheet of paper, with a generally T-shaped aperture in it that is open at an edge of the lcaf, to be releasably held by the loop means by pushing the aperture onto the loop means.

3. Leaf retaining element according to claim 2, wherein the loop comprises a flange around a tongue of the leaf retaining means that extends from the base portion thereof.

4. Leaf retaining element according to claim 3, wherein the flange extends on both sides of the tongue.

5. Leaf retaining element according to claim 2, wherein the said imaginary plane is the median bisector of the loop.

6. Leaf retaining element according to claim 2, wherein the said two points are spaced apart laterally of the general plane in which the loop lies.

7. Leaf retaining element according to claim 2, wherein the loop is narrower at a top of the loop to facilitate the addition or removal of leaves to the leaf retaining element.

8. A binder comprising at least two leaf retaining elements as claimed in claim 1 and a folder with at least two apertures in the region of a spine of the folder at the respective ends thereof, the shape of each hole in the folder corresponding to that of the base portion of each such leaf retaining element, the latter having been slid into the apertures in the folder.

9. A binder according to claim 8, having leaves of material formed with generally T-shaped apertures at the two ends of one side thereof for engaging the said leaf retaining elements, the T-shaped apertures opening at one of the edges of the leaf.

10. A binder according to claim 9, wherein each leaf comprises a folded sheet with the T-shaped apertures being formed at the fold.

11. A binder according to claim 8, wherein the folder has two parallel slots extending away from each aperture formed therein, so that the material of the folder between the slots yields to facilitate insertion of the base portion of the retaining means into the aperture in the folder and then the material between the slots is snapped against one end of the base portion of the leaf retaining elements to firmly secure the latter in the folder.

12. A binder according to claim 8, wherein the folder comprises a sheet of polypropylene.

13. A binder according to claim 8, where the folder comprises a sheet of metal or metal alloy.

14. A binder according to claim 8, wherein at least some of the inner edges which define the apertures are serrated to improve the securing of the leaf retaining elements in the folder.

* * * * *